US008157926B2

(12) United States Patent
Nagata et al.

(10) Patent No.: US 8,157,926 B2
(45) Date of Patent: Apr. 17, 2012

(54) PERMANENT MAGNET AND METHOD OF MANUFACTURING SAME

(75) Inventors: Hiroshi Nagata, Ibaraki (JP); Yoshinori Shingaki, Ibaraki (JP)

(73) Assignee: Ulvac, Inc., Kanagawa (JP)

( * ) Notice: Subject to any disclaimer, the term of this patent is extended or adjusted under 35 U.S.C. 154(b) by 334 days.

(21) Appl. No.: 12/519,891

(22) PCT Filed: Dec. 19, 2007

(86) PCT No.: PCT/JP2007/074407

§ 371 (c)(1),
(2), (4) Date: Jul. 16, 2009

(87) PCT Pub. No.: WO2008/075712

PCT Pub. Date: Jun. 26, 2008

(65) Prior Publication Data

US 2010/0051139 A1 Mar. 4, 2010

(30) Foreign Application Priority Data

Dec. 21, 2006 (JP) ..... 2006-344782

(51) Int. Cl.
*H01F 1/057* (2006.01)

(52) U.S. Cl. ..... 148/101; 148/302

(58) Field of Classification Search ..... None
See application file for complete search history.

(56) References Cited

U.S. PATENT DOCUMENTS

2006/0213583 A1 9/2006 Nakamura et al.
2007/0089806 A1* 4/2007 Blank et al. ..... 148/105
2008/0245442 A1* 10/2008 Nakamura et al. ..... 148/101
2008/0247898 A1* 10/2008 Nakamura et al. ..... 419/9
2010/0164663 A1* 7/2010 Nagata et al. ..... 335/302

FOREIGN PATENT DOCUMENTS

EP 1 643 513 A1 * 4/2006
JP 2004-006761 1/2004
JP 2005-175138 6/2005
JP 2006-303433 11/2006

(Continued)

OTHER PUBLICATIONS

Machine Translation of Japanese Patent Document No. 2004-006761, Jan. 2004.*

(Continued)

*Primary Examiner* — John Sheehan
(74) *Attorney, Agent, or Firm* — Cermak Nakajima LLP; Tomoko Nakajima

(57) ABSTRACT

There is provided a method of manufacturing a permanent magnet in which Dy and/or Tb adhered to the surface of a sintered magnet containing a lubricant can be efficiently diffused and in which the permanent magnet having high magnetic properties can be manufactured at good productivity. The permanent magnet is manufactured by executing a first step of adhering at least one of Dy and Tb to at least a part of a surface of a sintered magnet made by sintering iron-boron-rare earth based alloy raw meal powder containing a lubricant; and a second step of heat-treating the sintered magnet at a predetermined temperature to thereby disperse at least one of Dy and Tb adhered to the surface of the sintered magnet into grain boundary phase of the sintered magnet. At this time, as the sintered magnet, there is used one manufactured in an average grain size within a range of 4 μm~8 μm.

13 Claims, 4 Drawing Sheets

FOREIGN PATENT DOCUMENTS

WO WO2006/100968 9/2006

OTHER PUBLICATIONS

ASM Handbook, Formerly Ninth Edition, Metals Handbook, vol. 7, 1984, Powder Metallurgy, pp. 24 and 190-193.*

Kite, P., "Improvement of coercivity on thin Nd2Fe14B sintered permanent magnets," Mar. 23, 2000, Tohoku University, Doctor Thesis, pp. 91-112.

International Search Report for PCT Patent App. No. PCT/JP2007/074407 (Mar. 18, 2008).

* cited by examiner

FIG.5

| | Example | | | | | | | | |
|---|---|---|---|---|---|---|---|---|---|
| Average Grain Size (μ) | 2 | 3 | 4 | 5 | 6 | 7 | 8 | 9 | 10 |
| Br(kG) | 13.5 | 14.2 | 14.5 | 14.6 | 14.7 | 14.8 | 14.9 | 15.1 | 15.2 |
| (BH)max(MG0e) | 44.7 | 49.5 | 51 | 52 | 53.1 | 54 | 55 | 56 | 56 |
| iHc(k0e) | 32 | 32 | 32 | 31 | 32 | 30 | 29 | 26 | 25 |
| (BH)max+iHc | 76.7 | 81.5 | 83 | 83 | 85.1 | 84 | 84 | 82 | 81 |
| Heat Treatment Time for Most Optimum Diffusion (hr) | 18 | 12 | 6 | 6 | 4 | 6 | 6 | 8 | 12 |
| | Comparative Example | | This Invention | | | | | Comparative Example | |

PERMANENT MAGNET AND METHOD OF MANUFACTURING SAME

This application is a national phase entry under 35 U.S.C. §371 of PCT Patent Application No. PCT/JP2007/74407, filed on Dec. 19, 2007, which claims priority under 35 U.S.C. §119 to Japanese Patent Application No. 2006-344782, filed Dec. 21, 2006, both of which are incorporated by reference.

TECHNICAL FIELD

The present invention relates to a permanent magnet and a method of manufacturing the permanent magnet, and more particularly relates to a permanent magnet having high magnetic properties in which Dy and/or Tb is diffused into grain boundary phase of a Nd—Fe—B based sintered magnet, and to a method of manufacturing the permanent magnet.

BACKGROUND ART

A Nd—Fe—B based sintered magnet (so-called neodymium magnet) is made of a combination of iron and elements of Nd and B that are inexpensive, abundant, and stably obtainable natural resources and can thus be manufactured at a low cost and additionally has high magnetic properties (its maximum energy product is about 10 times that of ferritic magnet). Accordingly, the Nd—Fe—B sintered magnets have been used in various kinds of articles such as electronic devices and have recently come to be adopted in motors and electric generators for hybrid cars.

On the other hand, since the Curie temperature of the above-described sintered magnet is as low as about 300° C., there is a problem in that the Nd—Fe—B sintered magnet sometimes rises in temperature beyond a predetermined temperature depending on the circumstances of service of the product to be employed and therefore that it will be demagnetized by heat when heated beyond the predetermined temperature. In using the above-described sintered magnet in a desired product, there are cases where the sintered magnet must be fabricated into a predetermined shape. There is then another problem in that this fabrication gives rise to defects (cracks and the like) and strains to the grains of the sintered magnet, resulting in a remarkable deterioration in the magnetic properties.

Therefore, when the Nd—Fe—B sintered magnet is obtained, it is considered to add Dy and Tb which largely improve the grain magnetic anisotropy of principal phase because they have magnetic anisotropy of 4f-electron larger than that of Nd and because they have a negative Stevens factor similar to Nd. However, since Dy and Tb take a ferrimagnetism structure having a spin orientation negative to that of Nd in the crystal lattice of the principal phase, the strength of magnetic field, accordingly the maximum energy product exhibiting the magnetic properties is extremely reduced.

In order to solve this kind of problem, it has been proposed: to form a film of Dy and Tb to a predetermined thickness (to be formed in a film thickness of above 3 μm depending on the volume of the magnet) over the entire surface of the Nd—Fe—B sintered magnet; then to execute heat treatment at a predetermined temperature; and to thereby homogeneously diffuse the Dy and Tb that have been deposited (formed into thin film) on the surface into the grain boundary phase of the magnet (see non-patent document 1).

The permanent magnet manufactured in the above-described method has an advantage in that: because Dy and Tb diffused into the grain boundary phase improve the grain magnetic anisotropy of each of the grain surfaces, the nucleation type of coercive force generation mechanism is strengthened; as a result, the coercive force is dramatically improved; and the maximum energy product will hardly be lost (it is reported in non-patent document 1 that a magnet can be obtained having a performance, e.g., of the remanent flux density: 14.5 kG (1.45 T), maximum energy product: 50 MGOe (400 kJ/m$^3$), and coercive force: 23 kOe (3 MA/m)).

By the way, as an example of method of manufacturing Nd—Fe—B based sintered magnet, there is known a powder metallurgy process. In this method, first, Nd, Fe, and B are formulated in a predetermined composition ratio, melted, and cast to thereby manufacture an alloy raw material, which is once coarsely ground by a hydrogen grinding step, and then subsequently finely ground by, e.g., jet mill fine grinding sep to thereby obtain alloy raw meal powder. Then, the obtained alloy raw meal powder is oriented in magnetic field (alignment in magnetic field), and is compression-molded in a state in which the magnetic field is being charged, thereby obtaining a molded body. This molded body is then sintered under predetermined conditions to thereby manufacture a sintered magnet.

As a compression molding method in the magnetic field, there is generally used a uniaxial pressurizing type of compression molding machine. This compression molding machine is so arranged that alloy raw meal powder is filled into a cavity formed in a penetration hole in a die, and a compression (pressing) force is applied from both upper and lower directions by a pair of upper and lower punches to thereby form the alloy raw meal powder. At the time of compression molding by a pair of punches, due to friction among the alloy raw meal powder that is filled into the cavity and due to friction between the alloy raw meal powder and the wall surfaces of the die that is set in position in the punch, a high orientation cannot be obtained, resulting in a problem in that the magnetic properties cannot be improved.

As a solution, it is known to add to the obtained alloy raw meal powder a lubricant such as zinc stearate. In this manner, by securing flowability of the alloy raw meal powder at the time of compression molding in the magnetic field, the orientation is improved and also mold releasing from the die is facilitated (see non-patent document 2).

[Non-patent document 1] Improvement of coercivity on thin $Nd_2Fe_{14}B$ sintered permanent magnets (by Pak Kite of Tohoku University Doctor Thesis, Mar. 23, 2000)

[Non-patent document 2] JP-A-2004-6761 (see, e.g., the description of the column of prior art)

DISCLOSURE OF THE INVENTION

Problems to be Solved by the Invention

In a sintered magnet made by sintering an alloy material containing a lubricant, much carbon (ashes of lubricant) remains in the grain particles. From this fact, in case the above-described process for diffusing Dy, Tb adhered to the surface of the sintered magnet into the grain boundary phase is to be executed with the sintered magnet manufactured in this manner, there are cases where Dy, Tb reacts with the residual carbon (ashes of lubricants), resulting in disturbance of diffusion of Dy, Tb into the grain boundary phase. If the diffusion of Dy, Tb into the grain boundary phase is disturbed, the diffusion process cannot be executed in a short time, resulting in poor workability.

Therefore, in view of the above points, a first object of this invention is to provide a method of manufacturing a permanent magnet in which Dy, Tb adhered to the surface of the sintered magnet containing lubricants can be efficiently diffused into the grain particle phase, and in which the permanent magnet of high magnetic properties can be manufactured at high productivity. Further, a second object of this invention is to provide a permanent magnet in which Dy, Tb is efficiently diffused only into the grain particle phase of the Nd—Fe—B based sintered magnet containing lubricants and which has high magnetic properties.

Means for Solving the Problems

In order to solve the above-described problems, the method of manufacturing a permanent magnet comprises; a first step of adhering at least one of Dy and Tb to at least part of a surface of a sintered magnet made by sintering iron-boron-rare earth based alloy raw meal powder containing a lubricant; a second step of heat-treating the sintered magnet at a predetermined temperature to thereby disperse at least one of Dy and Tb adhered to the surface of the sintered magnet into grain boundary phase of the sintered magnet; wherein the sintered magnet employed is manufactured in an average grain size within a range of 4 μm~8 μm.

According to this invention, by setting the average grain size to a range of 4 μm~8 μm, Dy and/or Tb adhered to the surface of the sintered magnet can be efficiently diffused into the grain boundary phase without being affected by the carbon (ashes of a lubricant) residual inside the sintered magnet, thereby attaining high productivity. In this case, if the average grain size is smaller than 4 μm, although there can be obtained a permanent magnet having a high coercive force because Dy and/or Tb has been diffused into the grain boundary phase, there will be diminished the effect of adding the lubricant to the alloy raw meal powder in that, at the time of compression forming, flowability can be secured to thereby improve the orientation. Therefore, the orientation of the sintered magnet becomes poor and, as a result, the remanent flux density and the maximum energy product showing the magnetic properties are lowered.

On the other hand, if the average grain size is larger than 8 μm, the coercive force lowers because the grain is too large and, in addition, the surface area of the grain boundary becomes smaller, and the ratio of concentration of the residual carbon (ashes of lubricant) near the grain boundary becomes higher, thereby largely reducing the coercive force. In addition, the residual carbon reacts with Dy and/or Tb and the diffusion of Dy into the gain boundary phase will be hindered, whereby the diffusion time becomes longer and the workability becomes poor.

Preferably, the method further comprises: disposing the sintered magnet in the processing chamber and heating the same; heating an evaporating material containing at least one of Dy and Tb, the evaporating material being disposed in a same or another processing chamber; causing the evaporated evaporating material to be adhered to the surface of the sintered magnet by adjusting an amount of supply of the evaporated evaporating material to the surface of the sintered magnet; diffusing at least one of Dy and Tb in the adhered evaporating material into the grain boundary phase of the sintered magnet before a thin film made of the evaporated material is formed on the surface of the sintered magnet; and then executing the first step and the second step.

According to this configuration, the evaporated evaporating material is supplied to, and adhered to, the surface of the sintered magnet that has been heated to the predetermined temperature. At this time, since the sintered magnet was heated to a temperature at which the most optimum diffusion speed can be obtained, and since the amount of supply of the evaporating material to the surface of the sintered magnet was adjusted, the metal atoms of Dy and/or Tb in the evaporating material that was adhered to the surface were sequentially diffused into the grain boundary phase of the sintered magnet before the thin film was formed (i.e., the supply of the metal atoms such as Dy, Tb and the like to the surface of the sintered magnet and the diffusion thereof into the grain boundary phase are executed in a single processing (vacuum vapor processing). Therefore, the surface conditions of the permanent magnet are substantially the same as those before executing the above-described processing. The surface of the manufactured permanent magnet can be prevented from getting deteriorated (surface roughness from becoming worse). Excessive diffusion of Dy and/or Tb into the grain boundary near the surface of the sintered magnet can be prevented, and a particular post processing becomes not required, thereby attaining a high productivity.

Further, by causing Dy and/or Tb to be diffused and spread homogeneously into the grain boundary phase of the sintered magnet, there can be obtained a permanent magnet that has a Dy-rich phase and/or Tb-rich phase (phase containing Dy, Tb in the range of 5~80%) in the grain boundary phase, that has diffused Dy and/or Tb only in the neighborhood of the surface of the grains and, as a result of which, has a high coercive force and high magnetic properties. In addition, in case there have occurred defects (cracks) to the grains near the surface of the sintered magnet at the time of fabrication of the sintered magnet, there will be formed Dy-rich phase and/or Tb-rich phase on the inside thereof, thereby recovering the magnetization intensity and the coercive force.

In the above-described processing, if the sintered magnet and the evaporating material are disposed at a distance from each other, when the evaporating material is evaporated, the molten evaporating material can advantageously be prevented from directly getting adhered to the sintered magnet.

Preferably the adjustment of the amount of supply of the evaporating material to the surface of the sintered magnet is executed by varying a specific surface area of the evaporating material at a certain temperature, thereby increasing or decreasing the amount of evaporation. According to this configuration, without the need of changing the arrangement of the apparatus such, for example, as providing inside the processing chamber with separate parts required for increasing or decreasing the amount of supply of Dy and/or Tb to the surface of the sintered magnet, the amount of supply to the surface of the sintered magnet can be easily adjusted.

In order to remove stains, gases, and moisture adhered to the surface of the sintered magnet before diffusing Dy and/or Tb into the gain boundary phase, it is preferable to reduce the pressure in the processing chamber and maintain the pressure thereat prior to heating the processing chamber in which the sintered magnet is disposed.

In this case, in order to accelerate the removing of the stains, gases, and moisture adsorbed to the surface, it is preferable, after reducing the processing chamber to a predetermined pressure, to heat the processing chamber to a predetermined temperature and maintain the temperature thereat.

On the other hand, in order to remove oxidized film on the surface of the sintered magnet before diffusing Dy and/or Tb into the grain boundary phase, it is preferable to clean the surface of the sintered magnet by plasma prior to heating the processing chamber in which the sintered magnet is disposed.

Further, after having diffused Dy and/or Tb into the grain boundary phase of the sintered magnet, heat treatment is preferably executed to remove strains in the permanent magnet at a temperature lower than the said temperature. According to this configuration, there can be obtained a permanent magnet of high magnetic properties in which the magnetization intensity and coercive force are further improved or recovered.

In order to solve the above-described problems, the permanent magnet is made by: sintering iron-boron-rare earth based alloy raw meal powder containing a lubricant; adhering at least one of Dy and Tb to at least part of a surface of a sintered magnet which is manufactured so as to have an average grain size of 4 μm~8 μm; and executing heat treatment at a predetermined temperature so that at least one of Dy and Tb adhered to the surface of the sintered magnet is diffused into grain boundary phase of the sintered magnet.

Effects of the Invention

As described hereinabove, the method of manufacturing a permanent magnet according to this invention has the effects in: that Dy and/or Tb adhered to the surface of the sintered magnet containing therein a lubricant can be efficiently diffused into the grain boundary phase; and that a permanent magnet having a high productivity and high magnetic properties can be manufactured. Further, the permanent magnet according to this invention has an effect in that it has high magnetic properties and has a particularly high coercive force.

Best Mode for Carrying out the Invention

With reference to FIGS. 1 and 2, a permanent magnet M of the present invention is manufactured by simultaneously executing a series of processes (vacuum vapor processing) of: evaporating an evaporating material V containing at least one of Dy and Tb; causing the evaporated evaporating material V to be adhered to the surface of a Nd—Fe—B based sintered magnet S that has been machined to a predetermined shape; and diffusing the metal atoms of Dy and/or Tb of the adhered evaporating material V into the grain boundary phase.

The Nd—Fe—B based sintered magnet S as the starting material is manufactured as follows by a known method. That is, Fe, B, Nd are formulated at a predetermined ratio of composition to first manufacture an alloy material of 0.05 mm~0.5 mm by the known strip casting method. Alternatively, an alloy material having a thickness of about 5 mm may be manufactured by the known centrifugal casting method. In addition, a small amount of Cu, Zr, Dy, Tb, Al or Ga may be added therein during the formulation. Then, the manufactured alloy material is once coarsely ground by the known hydrogen grinding process and subsequently finely ground by the jet-mill fine grinding process, thereby obtaining alloy raw meal powder.

At the time of executing a forming step in the magnetic field as described hereinafter, the alloy raw meal powder has added thereto a lubricant in a predetermined mixing ratio, and the surface of the alloy raw meal is coated with this lubricant for the purpose of improving the orientation by securing the flowability of the alloy raw meal powder and also for the purpose of facilitating the releasing of the formed body off from the metal mold, and for other purposes. As the lubricant, solid lubricants or liquid lubricants having a low viscosity are used so that they do not damage the metal mold. As the solid lubricants, there can be listed lamellar compounds ($MoS_2$, $WS_2$, MoSe, graphite, BN, CFx, and the like), soft metal (Zn, Pb, and the like), rigid materials (diamond powder, TiN powder, and the like), organic high polymers (PTEE based, aliphatic nylon based, higher aliphatic based, fatty acid amide based, fatty acid ester based, metallic soap based, and the like). It is particularly preferable to use zinc stearate, ethylene amide, and fluoroether based grease.

On the other hand, as the liquid lubricant, there can be listed natural grease material (vegetable oils such as castor oil, coconut oil, palm oil, and the like; mineral oils; petroleum grease; and the like), and organic low molecular materials (low-grade aliphatic based, low-grade fatty acid amide based, low-grade fatty acid ester based). It is particularly preferable to use liquid fatty acid, liquid fatty acid ester, and liquid fluorine lubricant. Liquid lubricants are used with surfactant or by diluting with solvent. The carbon residue content of the lubricant that remains after sintering lowers the coercive force of the magnet. Therefore, it is preferable to use low molecular weight materials to facilitate the removal in the sintering step.

In case a solid lubricant is added to the alloy raw meal powder P, addition may be made in a mixing ratio of 0.02 wt %~0.1 wt %. If the mixing ratio is less than 0.02 wt %, the flowability of the alloy raw meal powder P will not be improved and, consequently, the orientation will not be improved. On the other hand, if the mixing ratio exceeds 0.1 wt %, the coercive force lowers under the influence of the carbon residue content that remains in the sintered magnet when the sintered magnet is obtained. Further, in case a liquid lubricant is added to the alloy raw meal powder P, it may be added in a range of 0.05 wt %~5 wt %. If the mixing ratio is less than 0.05 wt %, the flowability of the alloy raw meal powder will not be improved and, consequently, there is a possibility that the orientation will not be improved. On the other hand, if the mixing ration exceeds 5 wt %, the coercive force lowers under the influence of the carbon residue content that remains in the sintered magnet when the sintered magnet is obtained. By the way, as the lubricants, if both the solid lubricant and the liquid lubricant are added, the lubricants will be widely spread to every corner of the alloy raw meal powder P and, due to higher lubricating effect, a higher orientation can be obtained. Subsequently, by using, e.g., a uniaxial pressurizing type of compression molding machine (not illustrated) having a known construction, the alloy raw meal powder containing the lubricants: is formed into a predetermined shape in the magnetic field; is thereafter housed inside a known sintering furnace; and is sintered under predetermined conditions, whereby the above-described sintered magnet is manufactured.

By the way, in the sintered magnet made by sintering the alloy raw meal powder containing lubricants therein, even if the mixing ratio of the lubricants is set as described above, the grains of the sintered magnet have residual carbon (ash content of lubricants). Therefore, if Dy and/or Tb reacts with the residual carbon in executing the vacuum vapor processing, the diffusion of Dy and/or Tb into the grain boundary phase will be disturbed. As a result, the diffusion processing (and in turn the vacuum vapor processing) cannot be executed in a short time. In this embodiment, the conditions of manufacturing the sintered magnet S in each of the steps were optimized, and the average grain size of the sintered magnet S was made to fall within a range of 4 μm~8 μm. According to this arrangement, without being influenced by the residual carbon in the sintered magnet, Dy and/or Tb adhered to the surface of the sintered magnet can be efficiently diffused, thereby attaining a high productivity.

In this case, if the average grain size is less than 4 μm, there can be attained a permanent magnet having a high coercive force because Dy and/or Tb has been diffused into the grain boundary phase. However, there will be reduced the effect of adding the lubricants to the alloy raw meal powder, the effect being that the flowability is secured at the time of compression molding in the magnetic field and that the orientation is improved. The orientation of the sintered magnet will thus be worsened and, as a result, the remanent flux density and the maximum energy product indicating the magnetic properties will be lowered. On the other hand, if the average grain size is larger than 8 μm, the coercive force will be lowered and, in addition, the surface area of the grain boundaries becomes smaller. As a result, the ratio of concentration of the residual carbon near the grain boundaries becomes higher, and thus the coercive force is further lowered largely. In addition, the residual carbon reacts with Dy and/or Tb, and Dy is disturbed from getting diffused into the grain boundary phase, whereby the time of diffusion becomes longer and the productivity becomes poorer.

As shown in FIG. 2, a vacuum vapor processing apparatus 1 for executing the above-described processing has a vacuum chamber 12 in which a pressure can be reduced to, and kept at, a predetermined pressure (e.g., $1\times10^{-5}$ Pa) through an evacuating means 11 such as turbo-molecular pump, cryopump, diffusion pump, and the like. There is disposed in the vacuum chamber 12 a box body 2 comprising: a rectangular parallelopiped box part 21 with an upper surface being open; and a lid part 22 which is detachably mounted on the open upper surface of the box part 21.

A downwardly bent flange 22*a* is formed along the entire circumference of the lid part 22. When the lid part 22 is mounted in position on the upper surface of the box part 21, the flange 22*a* is fitted into the outer wall of the box part 21 (in this case, no vacuum seal such as a metal seal is provided), so as to define a processing chamber 20 which is isolated from the vacuum chamber 11. It is so configured that, when the vacuum chamber 12 is reduced in pressure through the evacuating means 11 to a predetermined pressure (e.g., $1\times10^{-5}$ Pa), the processing chamber 20 is reduced in pressure to a pressure (e.g., $5\times10^{-4}$ Pa) that is higher substantially by half a digit than that in the vacuum chamber 12.

The volume of the processing chamber 20 is set, taking into consideration the average free path of the evaporating material V, such that the metal atoms and the like of Dy, Tb in the vapor atmosphere can be supplied to the sintered magnet S directly or from a plurality of directions by repeating collisions. The surfaces of the box part 21 and the lid part 22 are set to have thicknesses not to be thermally deformed when heated by a heating means to be described hereinafter, and are made of a material that does not react with the evaporating material V.

In other words, when the evaporating material V is Dy, Tb, in case $Al_2O_3$ which is often used in an ordinary vacuum apparatus is used, there is a possibility that Dy, Tb in the vapor atmosphere reacts with $Al_2O_3$ and form products of reaction on the surface thereof, resulting in penetration of the Al atoms into the vapor atmosphere of Dy and/or Tb. Accordingly, the box body 2 is made, e.g., of Mo, W, V, Ta or alloys of them (including rare earth elements added Mo alloy, Ti added Mo alloy, and the like), CaO, $Y_2O_3$ or oxides of rare earth elements, or constituted by forming an inner lining on the surface of another insulating material. A bearing grid 21*a* of, e.g., a plurality of Mo wires (e.g., 0.1~10 mm (dia.)) is arranged in lattice at a predetermined height from the bottom surface in the processing chamber 20. On this bearing grid 21*a* a plurality of sintered magnets S can be placed side by side. On the other hand, the evaporating material V is appropriately placed on a bottom surface, side surfaces or a top surface of the processing chamber 20.

As the evaporating material V there is used Dy and/or Tb which largely improves the grain magnetic anisotropy of principal phase. In addition, there may be used fluorides containing at least one of Dy and Tb. In addition, there may be used one in which at least one of Dy and Tb is contained. In this case, the evaporating material V is formulated in a predetermined mixing ratio and by using, e.g., an electric arc furnace, an alloy of bulk form is obtained and disposed inside the processing chamber 20.

Further, the evaporating material V may comprise at least one material of the group consisting of Al, Ag, B, Ba, Be, C, Ca, Ce, Co, Cr, Cs, Cu, Er, Eu, Fe, Ga, Gd, Ge, Hf, Ho, In, K, La, Li, Lu, Mg, Mn, Mo, Na, Nb, Ni, P, Pd, Ru, S, Sb, Si, Sm, Sn, Sr, Ta, Ti, Tm, V, W, Y, Yb, Zn, and Zr.

The vacuum chamber 12 is provided with a heating means 3. The heating means 3 is made of a material that does not react with the evaporating material V, in the same manner as is the box body 2, and is arranged so as to enclose the circumference of the box body 2. The heating means 3 comprises: a thermal insulating material of Mo make which is provided with a reflecting surface on the inner surface thereof; and an electric heater which is disposed on the inside of the thermal insulating material and which has a filament of Mo make. By heating the box body 2 by the heating means 3 at a reduced pressure, the processing chamber 20 is indirectly heated through the box body 2, whereby the inside of the processing chamber 20 can be heated substantially uniformly.

A description will now be made of the manufacturing of a permanent magnet M using the above-described vacuum vapor processing apparatus 1. First of all, sintered magnets S made in accordance with the above-described method are placed on the bearing grid 21*a* of the box part 21, and Dy as the evaporating material V is placed on the bottom surface of the box part 21 (according to this, the sintered magnets S and the evaporating material V are disposed at a distance from each other in the processing chamber 20). After having mounted in position the lid part 22 on the open upper surface of the box part 21, the box body 2 is placed in a predetermined position enclosed by the heating means 3 in the vacuum chamber 12 (see FIG. 2). Then through the evacuating means 11 the vacuum chamber 12 is evacuated until it reaches a predetermined pressure (e.g., $1\times10^{-4}$ Pa) (the processing chamber 20 is evacuated to a pressure substantially half-digit higher than the above) and the processing chamber 20 is heated by actuating the heating means 3 when the vacuum chamber 12 has reached the predetermined pressure.

When the temperature in the processing chamber 20 has reached the predetermined temperature under reduced pressure, Dy placed on the bottom surface of the processing chamber 20 is heated to substantially the same temperature as the processing chamber 20, and starts evaporation, and accordingly a vapor atmosphere is formed inside the processing chamber 20. Since the sintered magnets S and Dy are disposed at a distance from each other, when Dy starts evaporation, molten Dy will not be directly adhered to the sintered magnet S whose surface Nd-rich phase is melted. Then Dy in the vapor atmosphere is supplied from a plurality of directions either directly or by repeating collisions, and adhered to the surface of the sintered magnet S that has been heated to a temperature substantially the same as that of the evaporating material V. Then, the Dy in the vapor atmosphere is supplied and adhered to the surface of the sintered magnet S that has been heated to the same temperature as the evaporating material, from a plurality of directions either directly or by repeating collisions. The adhered Dy is diffused into the grain boundary phase of the sintered magnet S, thereby obtaining a permanent magnet M.

As shown in FIG. 3, when the evaporating material V in the vapor atmosphere is supplied to the surface of the sintered magnet S so as to form a Dy layer (thin film) L1, the surface of the permanent magnet M will be remarkably deteriorated (surface roughness becomes worsened) as a result of recrystallization of the Dy that has been adhered to, and deposited on, the surface of the sintered magnet S. In addition, the Dy adhered to, and deposited on, the surface of the sintered magnet S that has been heated to substantially the same temperature during processing gets melted and Dy will be excessively diffused into the grains in a region R1 near the surface of the sintered magnet S. As a result, the magnetic properties cannot be effectively improved or recovered.

That is, once a thin film of Dy is formed on the surface of the sintered magnet S, the average composition on the surface of the sintered magnet S adjoining the thin film becomes Dy-rich composition. Once the composition becomes Dy-rich, the liquid phase temperature lowers and the surface of the sintered magnet S gets melted (i.e., the principal phase is melted and the amount of liquid phase increases). As a result, the region near the surface of the sintered magnet S is melted and collapsed and thus the asperities increase. In addition, Dy excessively penetrates into the grains together with a large amount of liquid phase and thus the maximum energy product and the remanent flux density exhibiting the magnetic properties are further lowered.

According to this embodiment, Dy in bulk form (substantially spherical shape) having a small surface area per unit volume (specific surface area) was disposed on the bottom surface of the processing chamber 20 in a ratio of 1~10% by weight of the sintered magnet so as to reduce the amount of evaporation at a constant temperature. In addition, when the evaporating material V is Dy, the temperature in the processing chamber 20 was set to a range of 800° C.~1050° C., preferably 900° C.~1000° C., by controlling the heating means 3 (e.g., when the temperature in the processing chamber is 900° C.~1000° C., the saturated vapor pressure of Dy will be about $1\times10^{-2}$ Pa~$1\times10^{-1}$ Pa).

If the temperature in the processing chamber 20 (accordingly the heating temperature of the sintered magnet S) is below 800° C., the velocity of diffusion of Dy atoms adhered to the surface of the sintered magnet S into the grain boundary phase is retarded. It is thus impossible to make the Dy atoms to be diffused and homogeneously penetrated into the grain boundary phase of the sintered magnet before the thin film is formed on the surface of sintered magnet S. On the other hand, at the temperature above 1050° C., the vapor pressure of Dy increases and thus the Dy atoms in the vapor atmosphere are excessively supplied to the surface of the sintered magnet S. In addition, there is a possibility that Dy would be diffused into the grains. Should Dy be diffused into the grains, the magnetization intensity in the grains is greatly reduced and, therefore, the maximum energy product and the remanent flux density are further reduced.

In order to diffuse Dy into the grain boundary phase before the Dy thin film is formed on the surface of the sintered magnet S, the ratio of a total surface area of the sintered magnet S disposed on the bearing grid 21*a* in the processing chamber 20 to a total surface area of the evaporating material V in bulk form disposed on the bottom surface of the processing chamber 20 is set to fall in a range of $1\times10^{-4}$~$2\times10^{3}$. In a ratio other than the range of $1\times10^{-4}$~$2\times10^{3}$, there are cases where a thin film is formed on the surface of the sintered magnet S and thus a permanent magnet having high magnetic properties cannot be obtained. In this case, the above-described ratio shall preferably fall within a range of $1\times10^{-3}$ to $1\times10^{3}$, and the above-described ratio of $1\times10^{-2}$ to $1\times10^{2}$ is more preferable.

According to the above configuration, by lowering the vapor pressure and also by reducing the amount of evaporation of Dy, the amount of supply of Dy atoms to the sintered magnet S is restrained. In addition, by heating the sintered magnet S at a predetermined temperature range while arranging the average grain diameter of the sintered magnet S within a predetermined range, the diffusion speed will be accelerated without being influenced by the remaining carbon inside the sintered magnet. As a result of combined effects of the above, the Dy atoms adhered to the surface of the sintered magnet S can be efficiently diffused into the grain boundary phase of the sintered magnet S for homogeneous spreading before getting adhered to the surface of the sintered magnet S and forming a Dy layer (thin film) (see FIG. 1). As a result, the permanent magnet M can be prevented from deteriorating on the surface thereof, and Dy can be restrained from being excessively diffused into the grain boundary near the surface of the sintered magnet. In this manner, by having a Dy-rich phase (a phase containing Dy in the range of 5~80%) in the grain boundary phase and by diffusing Dy only in the neighborhood of the surface of the grains, the magnetization intensity and coercive force are effectively improved. In addition, there can be obtained a permanent magnet M that requires no finishing work and that is superior in productivity.

As shown in FIG. 4, when the sintered magnet S is worked into a desired configuration by a wire cutter, and the like, after having manufactured the above-described sintered magnet S, there are cases where cracks occur in the grains which are the principal phase on the surface of the sintered magnet, resulting in a remarkable deterioration in the magnetic properties (see FIG. 4(*a*)). However, by executing the above-described vacuum vapor processing, there will be formed a Dy-rich phase on the inside of the cracks of the grains near the surface (see FIG. 4(*b*)), whereby the magnetization intensity and coercive force are recovered.

Cobalt (Co) has been added to the neodymium magnet of the prior art because a measure to prevent corrosion of the magnet is required. However, according to the present invention, since Dy-rich phase having extremely higher corrosion resistance and atmospheric corrosion resistance as compared with Nd exists on the inside of cracks of grains near the surface of the sintered magnet and in the grain boundary phase, it is possible to obtain a permanent magnet having extremely high corrosion resistance and atmospheric corrosion resistance without using Co. Furthermore, at the time of diffusing Dy adhered to the surface of the sintered magnet, since there is no intermetallic compound containing Co in the grain boundary phase of the sintered magnet S, the metal atoms of Dy, Tb are further efficiently diffused.

Finally, after having executed the above-described processing for a predetermined period of time (e.g., 1~72 hours), the operation of the heating means 3 is stopped, Ar gas of 10 KPa is introduced into the processing chamber 20 through a gas introducing means (not illustrated), evaporation of the evaporating material V is stopped, and the temperature in the processing chamber 20 is once lowered to, e.g., 500° C. Continuously the heating means 3 is actuated once again and the temperature in the processing chamber 20 is set to a range of 450° C.~650° C., and heat treatment for removing the strains in the permanent magnets is executed to further improve or recover the coercive force. Finally, the processing chamber 20 is rapidly cooled substantially to room temperature and the box body 2 is taken out of the vacuum chamber 12.

In the embodiment of the present invention, a description has been made of an example in which Dy is used as the evaporating material. However, within a heating temperature range (a range of 900° C.~1000° C.) of the sintered magnet S that can accelerate the diffusion velocity, Tb that is low in vapor pressure can be used. Or else, an alloy of Dy and Tb may be used. It was so arranged that an evaporating material V in bulk form and having a small specific surface area was used in order to reduce the amount of evaporation at a certain temperature. However, without being limited thereto, it may be so arranged that a pan having a recessed shape in cross section is disposed inside the box part 21 to contain in the pan the evaporating material V in granular form or bulk form, thereby reducing the specific surface area. In addition, after having placed the evaporating material V in the pan, a lid (not illustrated) having a plurality of openings may be mounted.

In the embodiment of the present invention, a description has been made of an example in which the sintered magnet S and the evaporating material V were disposed in the processing chamber 20. However, in order to enable to heat the sintered magnet S and the evaporating material V at different temperatures, an evaporating chamber (another processing chamber, not illustrated) may be provided inside the vacuum chamber 12, aside from the processing chamber 20, and another heating means may be provided for heating the evaporating chamber. After having evaporated the evaporating material V inside the evaporating chamber, the evaporating material V in the vapor atmosphere may be arranged to be supplied to the sintered magnet inside the processing chamber 20 through a communicating passage which communicates the processing chamber 20 and the evaporating chamber together.

In this case, if the evaporating material V is Dy, the evaporating chamber may be heated in a range of 700° C.~1050° C. (at the time of 700° C.~1050° C., the vapor pressure of Dy will be about $1\times10^{-4}$ ~$1\times10^{-1}$ Pa). At a temperature below 700° C., a vapor pressure will not be reached at which Dy can be supplied to the surface of the sintered magnet S so as to homogeneously spread Dy into the grain boundary phase. On the other hand, in case the evaporating material V is Tb, the evaporating chamber may be heated in a range of 900° C.~1150° C. At a temperature below 900° C., the vapor pressure will not be reached at which Tb atoms can be supplied to the surface of the sintered magnet S. On the other hand, at a temperature above 1150° C., Tb will be diffused into the grains, thereby lowering the maximum energy product and the remanent flux density.

In addition, in this embodiment, description has been made of a case in which vacuum vapor processing is executed in order to attain a high productivity. This invention can also be applied to the case in which a permanent magnet is obtained by causing Dy and/or Tb to be adhered to the surface of the sintered magnet (first step) by using a known vapor deposition apparatus or a sputtering apparatus, and subsequently by executing diffusion processing to cause the Dy and/or Tb adhered to the surface to be diffused into the grain boundary phase of the sintered magnet by using a heat treating furnace (second step). A permanent magnet of high magnetic properties can thus be obtained.

In order to remove soil, gas or moisture adsorbed on the surface of sintered magnet S before Dy and/or Tb is diffused into the grain boundary phase, it may be so arranged that the vacuum chamber 12 is reduced to a predetermined pressure (e.g., $1\times10^{-5}$ Pa) through the evacuating means 11 and that the processing chamber 20 is reduced to a pressure (e.g., $5\times10^{-4}$ Pa) higher substantially by half-digit than the pressure in the processing chamber 20, thereafter maintaining the pressures for a predetermined period of time. At that time, by actuating the heating means 3, the inside of the processing chamber 20 may be heated to, e.g., 100° C., thereafter maintaining it for a predetermined period of time.

On the other hand, the following arrangement may be made, i.e., a plasma generating apparatus (not illustrated) of a known construction for generating Ar or He plasma inside the vacuum chamber 12 is provided and, prior to the processing inside the vacuum chamber 12, there may be executed a preliminary processing of cleaning the surface of the sintered magnet S by plasma. In case the sintered magnet S and the evaporating material V are disposed in the same processing chamber 20, a known conveyor robot may be disposed in the vacuum chamber 12, and the lid part 22 may be mounted inside the vacuum chamber 12 after the cleaning has been completed.

Further in the embodiment of the present invention, a description has been made of an example in which the box body 2 was constituted by mounting the lid part 22 on an upper surface of the box part 21. However, if the processing chamber 20 is isolated from the vacuum chamber 12 and can be reduced in pressure accompanied by the pressure reduction in the vacuum chamber 12, it is not necessary to limit to the above example. For example, after having housed the sintered magnet S into the box part 21, the upper opening thereof may be covered by a foil of Mo make. On the other hand, it may be so constructed that the processing chamber 20 can be hermetically closed in the vacuum chamber 12 so as to be maintained at a predetermined pressure independent of the vacuum chamber 12.

As the sintered magnet S, the smaller is the amount of oxygen content, the larger becomes the velocity of diffusion of Dy and/or Tb into the grain particle phase. Therefore, the oxygen content of the sintered magnet S itself may be below 3000 ppm, preferably below 2000 ppm, and most preferably below 1000 ppm.

Example 1

As a Nd—Fe—B based sintered magnet, there was used one whose composition was 20Nd-5Pr-2Dy-1B-1Co-0.2Al-0.05Cu-0.1Nb-0.1Mo-bal.Fe and was fabricated into a rectangular parallelepiped of 5×40×40 mm. In this case, Fe, Nd, Pr, Dy, B, Co, Al, Cu, Nb and Mo were formulated in the above-described composition ratio to manufacture an alloy of 30 mm by a known centrifugal casting method. The alloy was once roughly ground in a known hydrogen grinding step and was subsequently finely ground by a jet mill fine grinding step, thereby obtaining an alloy raw meal powder.

Subsequently, this alloy raw meal powder was agitated by adding, in a mixing ratio of 0.05 wt %, a mixture of lubricant of a fatty acid based compound and a fatty acid metal salt lubricant; was filled into a cavity of a known a uniaxial pressurizing type of compression molding machine; and was formed into a predetermined shape in a magnetic field (forming step). The molded body thus obtained was disposed in a known sintering furnace and was sintered under predetermined conditions (sintering step). In this case, by optimizing the forming step and the sintering step, a sintered magnet S was obtained in a range of average grain size of 2 μm~10 μm so that the oxygen content became 500 ppm. By the way, an average grain size of the sintered magnet was obtained, after having etched the surface of the sintered magnet, the surface being perpendicular to the magnetic alignment direction, in a segment method by drawing 10 random lines on a microscopic composition photograph.

Then, by using the above-described vacuum vapor processing apparatus 1, a permanent magnet M was obtained by the above-described vacuum vapor processing. In this case, 100 pieces of sintered magnets S were disposed on the bearing grid 21*a* inside the box body 2 of Mo make at an equal distance to one another. In addition, as the evaporating material, there was used Dy of bulk form of 99.9% purity and a total amount of 10 g was disposed on the bottom surface of the processing chamber 20. Then, by actuating the evacuating means, the vacuum chamber was once reduced in pressure to $1\times10^{-4}$ Pa (the pressure inside the processing chamber was $5\times10^{-3}$ Pa) and the heating temperature of the processing chamber 20 by the heating means 3 was set to 950° C. After the processing chamber 20 has reached 950° C. in temperature, the above-described processing was executed in this state for 1~72 hours. Then, heat treatment was executed for removing the strains in the permanent magnet. In this case, the heat treatment temperature was set to 400° C. and the processing time was set to 90 minutes, and the most optimum vacuum vapor processing time that can obtain the highest magnetic properties was obtained (i.e., the most optimum time for diffusion of Dy).

FIG. 5 is a table showing average values of the magnetic properties when the permanent magnet was obtained under the above-described conditions. According to this, when the average grain size was below 3 μm or above 9 μm, the most optimum vacuum vapor processing time was above 8 hours, resulting in poor workability. It can also be seen that, when the average gain size was above 9 μm, the coercive force cannot effectively be improved. On the other hand, when the average grain size of the sintered magnet was 4~8 μm, the most optimum vacuum vapor processing time was 4~6 hours. It can also be seen that there was obtained a permanent magnet with high magnetic properties whose maximum energy product was above 51 MGOe, remanent magnetic flux density was above 14.5 kG, and the coercive force was about 30 kOe.

BRIEF DESCRIPTION OF THE DRAWINGS

FIG. 5 is a table showing average values of magnetic properties of the permanent magnet manufactured in accordance with Example 1a and a most optimum vacuum vapor processing time.

DESCRIPTION OF REFERENCE NUMERALS AND CHARACTERS

Figure 1:
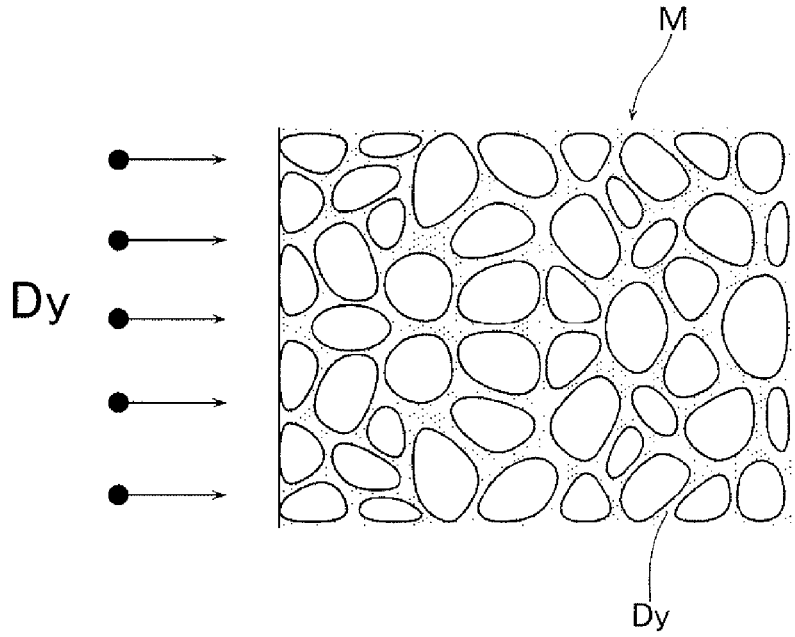
FIG. 1 is a schematic explanatory view of a cross-section of the permanent magnet manufactured in accordance with this invention.
Figure 2:
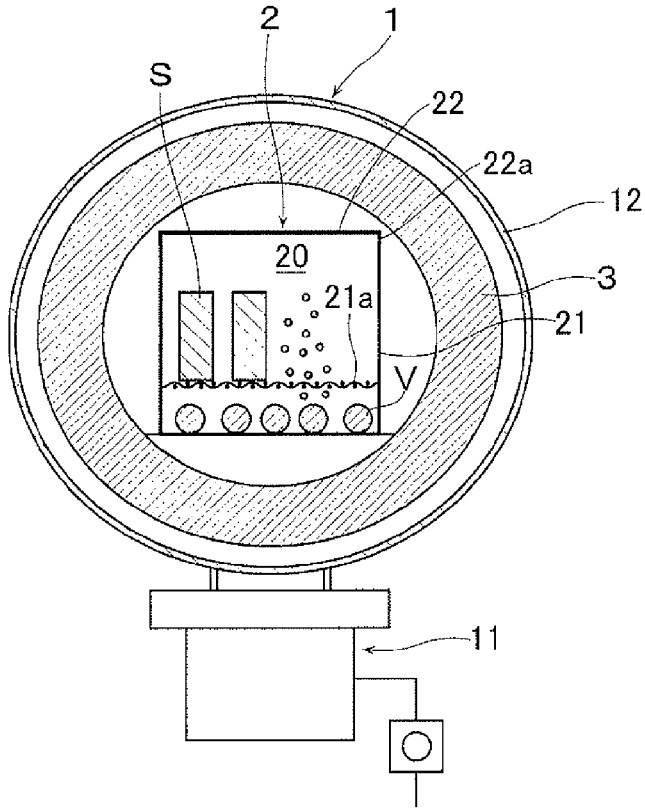
FIG. 2 is a schematic view of the vacuum processing apparatus for executing the processing of this invention.
Figure 3:
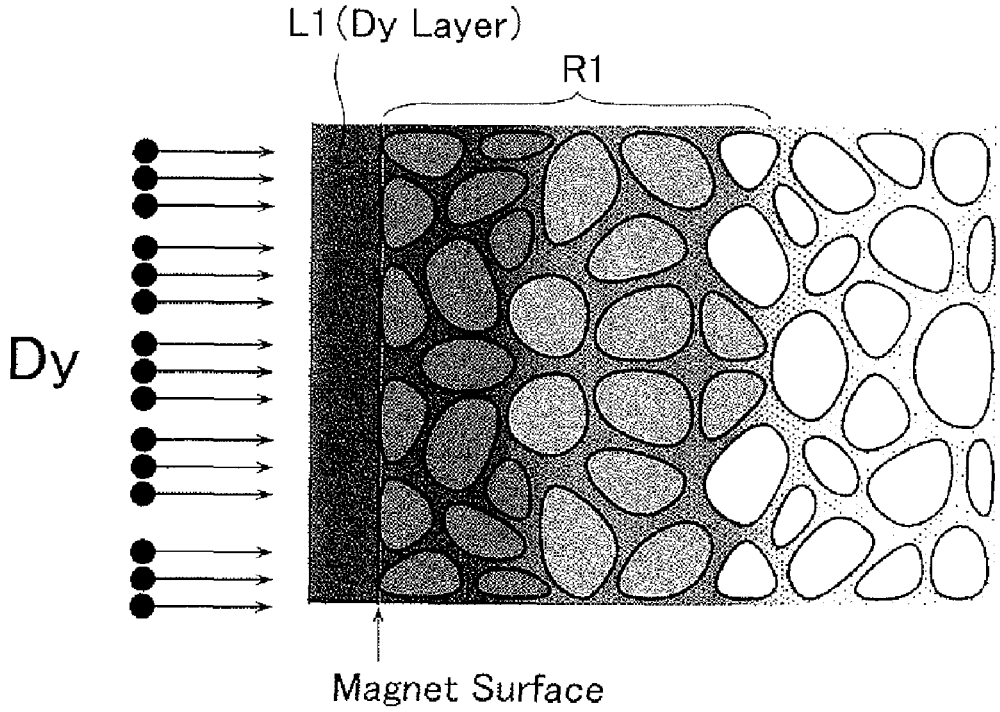
FIG. 3 is a schematic explanatory view of a cross-section of a permanent magnet manufactured in accordance with a prior art.
Figure 4A:
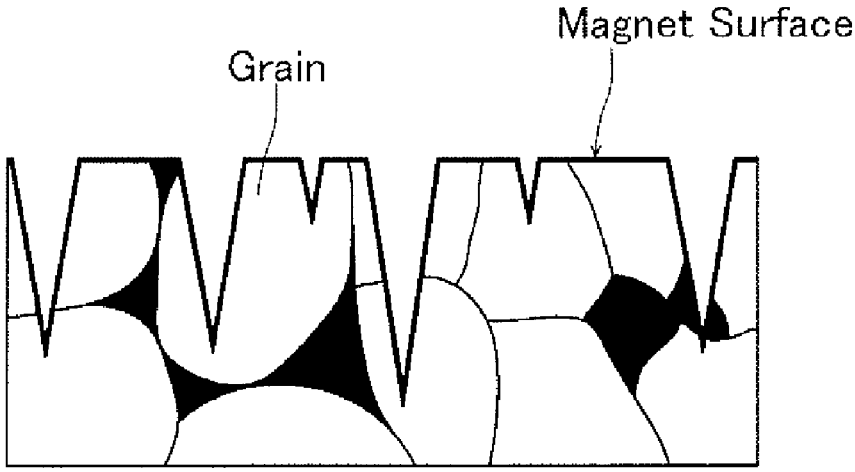
FIG. 4 (*a*) is an explanatory view showing deterioration of the surface of the sintered magnet caused by machining, and FIG. 4 (*b*) is an explanatory view showing the surface condition of a permanent magnet manufactured in accordance with this invention.
Figure 4B:
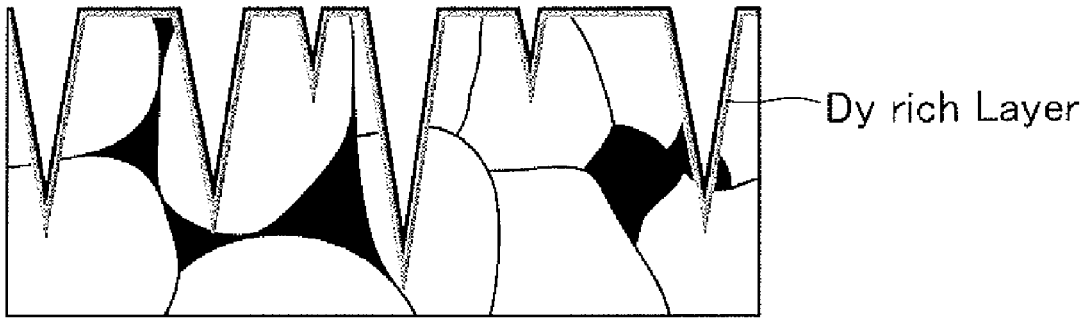

1 vacuum vapor processing apparatus
12 vacuum chamber
20 processing chamber
2 box body
21 box part
22 lid part
3 heating means
S sintered magnet
M permanent magnet
V evaporating material

What is claimed is:

1. A method of manufacturing a permanent magnet comprising;

a first step of adhering at least one of Dy and Tb to at least a part of a surface of a sintered magnet made by sintering iron-boron-rare earth based alloy raw metal powder containing a lubricant;

a second step of heat-treating the sintered magnet at a first predetermined temperature to thereby disperse the at least one of Dy and Tb adhered to the surface of the sintered magnet into grain boundary phase of the sintered magnet;

wherein the sintered magnet employed is manufactured to have an average grain size within a range of 4 μm~8 μm.

2. The method of manufacturing a permanent magnet according to claim 1, before executing the first step and the second step, further comprising:

disposing the sintered magnet in a processing chamber and heating the same;

heating an evaporating material containing at least one of Dy and Tb, the evaporating material being disposed in the processing chamber or another processing chamber;

causing the evaporated evaporating material to be adhered to the surface of the sintered magnet by adjusting an amount of supply of the evaporated evaporating material to the surface of the sintered magnet; and diffusing the at least one of Dy and Tb in the adhered evaporating material into the grain boundary phase of the sintered magnet before a thin film made of the evaporated material is formed on the surface of the sintered magnet.

3. The method of manufacturing a permanent magnet according to claim 2, wherein the sintered magnet and the evaporating material are disposed at a distance from each other.

4. The method of manufacturing a permanent magnet according to claim 2, wherein the adjustment of the amount of supply of the evaporating material to the surface of the sintered magnet is executed by varying a specific surface area of the evaporating material at a certain temperature, thereby increasing or decreasing the amount of evaporation.

5. The method of manufacturing a permanent magnet according to claim 2, further comprising, prior to heating the processing chamber in which the sintered magnet is disposed, reducing the pressure in the processing chamber and maintaining the pressure thereat.

6. The method of manufacturing a permanent magnet according to claim 5, further comprising, after reducing the processing chamber to a predetermined pressure, heating the processing chamber to a predetermined temperature and maintaining the temperature thereat.

7. The method of manufacturing a permanent magnet according to claim 2, further comprising, prior to heating the processing chamber in which the sintered magnet is disposed, cleaning the surface of the sintered magnet by plasma.

8. The method of manufacturing a permanent magnet according to claim 2, further comprising, after having diffused metal atoms of the at least one of Dy and Tb into the grain boundary phase of the sintered magnet, executing heat treatment to remove strains in the permanent magnet at a second predetermined temperature lower than the first predetermined temperature.

9. A permanent magnet made by:

sintering iron-boron-rare earth based alloy raw metal powder containing a lubricant to form a sintered magnet;

adhering at least one of Dy and Tb to at least part of a surface of the sintered magnet which is manufactured so as to have an average grain size of 4 μm~8 μm; and executing heat treatment at a predetermined temperature so that the at least one of Dy and Tb adhered to the surface of the sintered magnet is diffused into grain boundary phase of the sintered magnet.

10. The method of manufacturing a permanent magnet according to claim 3, wherein the adjustment of the amount of supply of the evaporating material to the surface of the sintered magnet is executed by varying a specific surface area of the evaporating material at a certain temperature, thereby increasing or decreasing the amount of evaporation.

11. The method of manufacturing a permanent magnet according to claim 3, further comprising, prior to heating the processing chamber in which the sintered magnet is disposed, reducing the pressure in the processing chamber and maintaining the pressure thereat.

12. The method of manufacturing a permanent magnet according to claim 3, further comprising, prior to heating the processing chamber in which the sintered magnet is disposed, cleaning the surface of the sintered magnet by plasma.

13. The method of manufacturing a permanent magnet according to claim 3, further comprising, after having diffused metal atoms of the at least one of Dy and Tb into the grain boundary phase of the sintered magnet, executing heat treatment to remove strains in the permanent magnet at a second predetermined temperature lower than the first predetermined temperature.

* * * * *